US007758475B2

(12) United States Patent
Goldberg

(10) Patent No.: US 7,758,475 B2
(45) Date of Patent: Jul. 20, 2010

(54) UPPER BODY EXERCISE CYCLE

(75) Inventor: Johnny Goldberg, Montecito, CA (US)

(73) Assignee: Five Girl, Inc., Montecito, CA (US)

( * ) Notice: Subject to any disclaimer, the term of this patent is extended or adjusted under 35 U.S.C. 154(b) by 129 days.

(21) Appl. No.: 12/002,414

(22) Filed: Dec. 14, 2007

(65) Prior Publication Data

US 2009/0156371 A1 Jun. 18, 2009

Related U.S. Application Data

(60) Provisional application No. 60/920,257, filed on Mar. 26, 2007.

(51) Int. Cl.
*A63B 22/12* (2006.01)

(52) U.S. Cl. ..... 482/62; 482/57

(58) Field of Classification Search ..... 482/57, 482/62, 63

See application file for complete search history.

(56) References Cited

U.S. PATENT DOCUMENTS

| | | | | |
|---|---|---|---|---|
| 2,783,044 | A | 2/1957 | Sbarra | |
| D191,792 | S | 11/1961 | Maratta | |
| 3,994,509 | A | 11/1976 | Schaeffer | |
| 4,071,235 | A * | 1/1978 | Zent | 482/62 |
| 4,423,863 | A * | 1/1984 | Figueroa | 482/62 |
| 3,823,959 | A | 7/1984 | Winters | |
| 4,582,318 | A * | 4/1986 | Giannelli et al. | 482/58 |
| 4,592,544 | A | 6/1986 | Smith et al. | |
| 4,618,141 | A | 10/1986 | Ashworth, Jr. | |
| 4,625,962 | A * | 12/1986 | Street | 482/116 |
| 4,705,269 | A * | 11/1987 | DeBoer et al. | 482/62 |
| 4,749,182 | A * | 6/1988 | Duggan | 482/114 |
| 4,871,164 | A | 10/1989 | Tseng | |
| 4,900,014 | A | 2/1990 | DeGraff | |
| 5,072,929 | A | 12/1991 | Peterson et al. | |
| 5,088,340 | A | 2/1992 | Seol | |
| 5,145,479 | A | 9/1992 | Olschansky et al. | |
| 5,232,422 | A * | 8/1993 | Bishop, Jr. | 482/57 |
| 5,242,179 | A * | 9/1993 | Beddome et al. | 280/233 |
| 5,256,117 | A | 10/1993 | Potts et al. | |
| 5,354,084 | A | 10/1994 | Lofgren et al. | |
| 5,449,334 | A | 9/1995 | Kingsbury | |
| 5,496,238 | A | 3/1996 | Taylor | |
| 5,580,338 | A | 12/1996 | Scelta et al. | |
| 5,735,774 | A | 4/1998 | Maresh | |
| 5,853,184 | A | 12/1998 | Lofgren et al. | |
| 5,857,943 | A | 1/1999 | Murray | |
| 5,860,329 | A | 1/1999 | Day | |
| 5,906,563 | A | 5/1999 | Pittari | |
| 5,967,946 | A | 10/1999 | Beatty, Jr. | |
| 5,980,431 | A * | 11/1999 | Miller, Jr. | 482/57 |
| 5,989,162 | A | 11/1999 | Daniels | |
| 6,764,432 | B2 | 7/2004 | Hippensteel | |
| 6,840,892 | B1 | 1/2005 | Wu | |
| 6,902,515 | B2 | 6/2005 | Howell et al. | |
| 6,960,155 | B2 | 11/2005 | Chien et al. | |

(Continued)

*Primary Examiner*—Fenn C Mathew
*Assistant Examiner*—Andrew M Tecco
(74) *Attorney, Agent, or Firm*—Cislo & Thomas, LLP

(57) ABSTRACT

An upper body exercise cycle comprising crank arms that may independently drive a flywheel, which provides resistance to the crank arms, an adjustable headstock and seat to accommodate users of different sizes and isolate different muscle groups, and a base plate ramp to provide support for the feet and to facilitate transportation of the upper body exercise cycle.

11 Claims, 16 Drawing Sheets

U.S. PATENT DOCUMENTS 7,172,532 B2 * 2/2007 Baker ..... 482/57
7,282,014 B2 10/2007 Krietzman
7,494,449 B2 2/2009 Eschenbach
7,530,932 B2 * 5/2009 Lofgren et al. ..... 482/62
2005/0143226 A1 6/2005 Heidecke
2006/0116248 A1 6/2006 Lofgren et al.

* cited by examiner

UPPER BODY EXERCISE CYCLE

CROSS-REFERENCE TO RELATED APPLICATION

This patent application claims the benefit of U.S. Provisional Patent Application Ser. No. 60/920,257, filed Mar. 26, 2007, entitled "Upper Body Exercise Cycle."

BACKGROUND OF THE INVENTION

1. Technical Field

This invention relates to exercise equipment.

2. Background Art

There are numerous exercising devices, and in particular, a number of exercise cycles. Most exercise cycles, however are designed to condition the legs. There are exercise cycles designed to exercise the arms as well. However, most of these exercise cycles have dependent crank arms such that rotation of one crank arm causes rotation of the other crank arm. Some exercise cycles have independent crank arms but require two chains either attached to the same wheel or to two different wheels. Thus, there exist a need for an exercise cycle to workout the upper body with independently rotating crank arms, such that a user may exercise each arm independently or both arms simultaneously.

BRIEF SUMMARY OF INVENTION

The present invention is directed to an upper body exercise cycle. The device comprises two independent crank arms that may each independently rotate a flywheel. The crank assembly utilizes a ratchet and pawl mechanism to allow the crank arms to be independent. This allows the crank arms to be rotated singly or concomitantly, thereby allowing the user to exercise both arms or to focus on one arm. The flywheel employs an adjustable resistance mechanism to change the resistance in the crank arms to accommodate users of different strength and to change the level of difficulty for a particular user. The flywheel also employs a ratchet and pawl mechanism to allow the flywheel to freewheel. In other words, although the crank arms can drive the flywheel, but the flywheel cannot drive the crank arms, thereby reducing the possibility of injury from a crank arm rotating faster than the user's capability. The headstock and seat may be adjusted to accommodate user's of various sizes. Also, the adjustability of the headstock allows user's to isolate different muscle groups. The upper body exercise cycle may be placed on a base plate ramp to facilitate proper feet positioning as well as facilitating the means of transporting the upper body exercise cycle. The upper body exercise cycle also features unique designs that are aesthetically pleasing.

Using this upper body exercise cycle is simple, fun, and easy. It provides cardiovascular as well as upper body strength benefits. The natural, smooth, rhythmic rotational movements provide a comfortable way of exercising.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description also sets forth the functions and the sequence of steps for operating the invention in connection with the illustrated embodiments. It is to be understood, however that the same or equivalent functions and sequences may be accomplished by different embodiments that are also intended to be encompassed within the spirit and scope of the invention.

Figure 1:
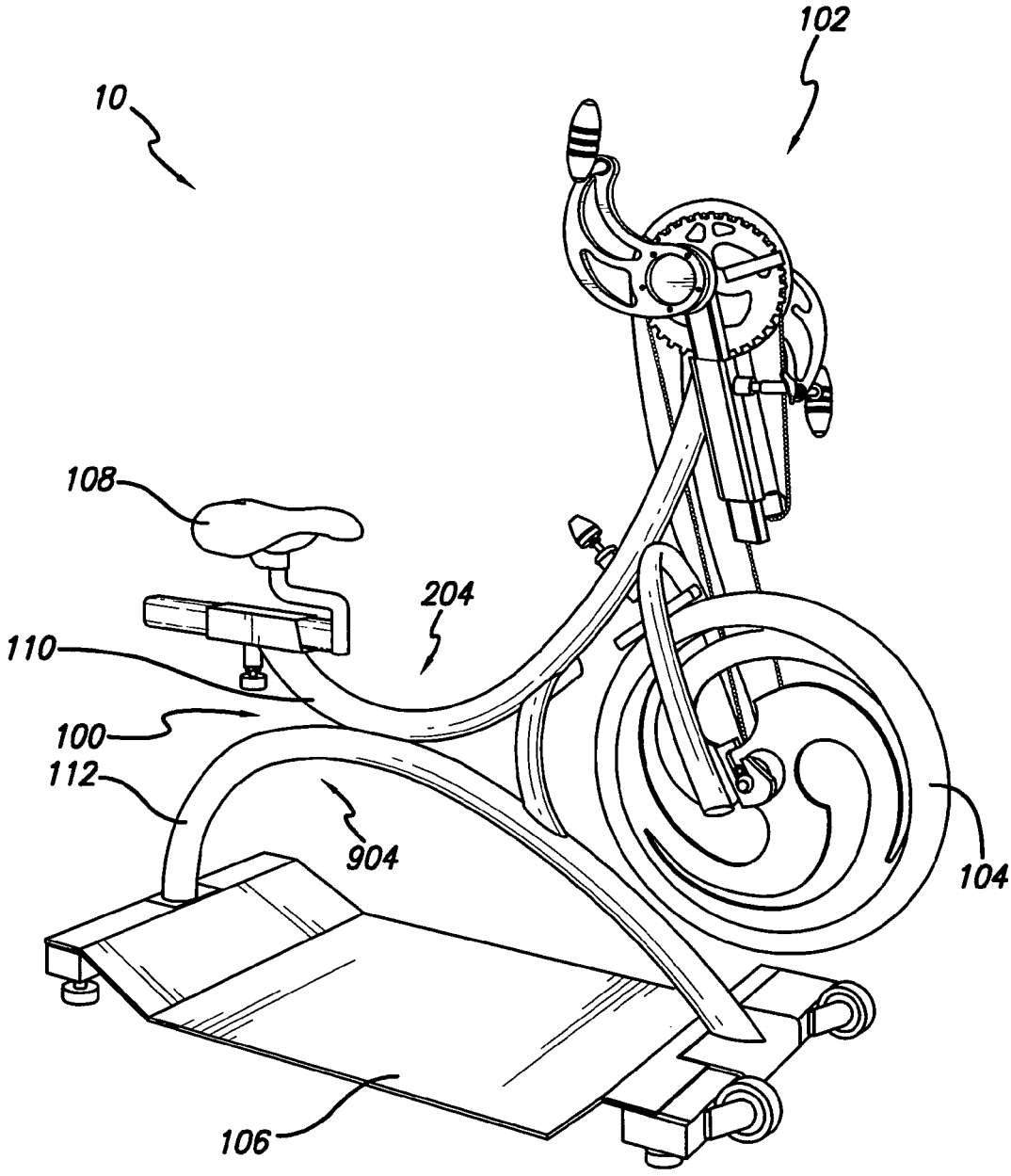
FIG. 1 is a perspective view of an embodiment of the current invention.
Figure 2:
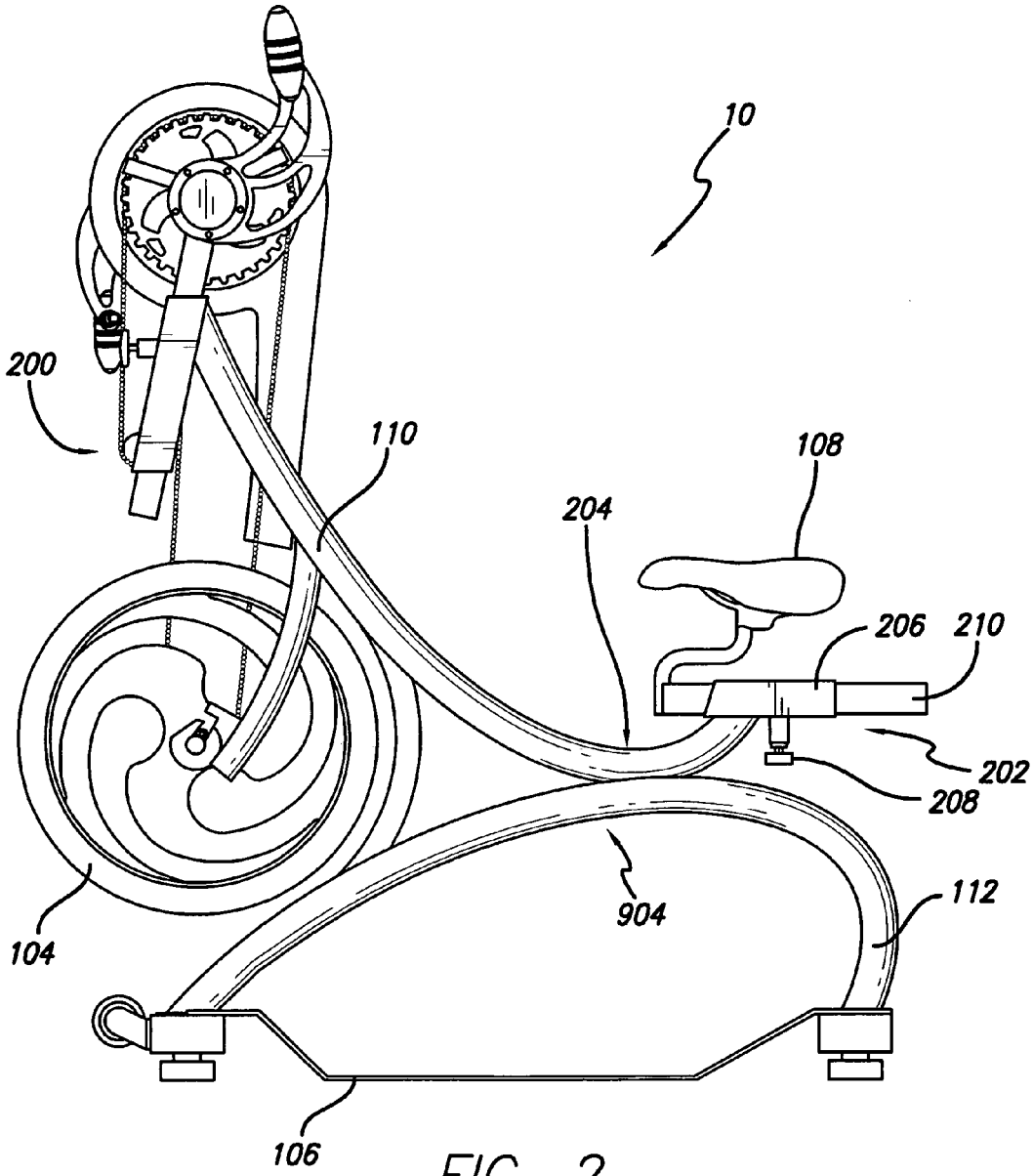
FIG. 2 is a side view of an embodiment of the current invention.

As shown in FIGS. 1 and 2, the present invention is an exercise cycle 10 for the upper-body comprising a base frame 100, a crank assembly 102, and a flywheel 104 such that the base frame 100 supports the crank assembly 102 and the flywheel 104, the crank assembly 102 drives the flywheel 104, and the flywheel 104 provides resistance to the crank assembly 102. In a preferred embodiment, the exercise cycle 10 further comprises a base plate ramp 106 and a seat 108.

The base frame 100 comprises a front portion 200 and a rear portion 202. The base frame 100 further comprises an upper frame 110 and a lower frame 112. The upper frame 110 has an upper elliptical bend 204. Although the upper frame 110 is shown as an upper elliptical bend 204, the upper frame 110 may be many different shapes. For example, the upper frame 110 may be partially parabolic, semi-circular, square, or v-shaped. It is preferred that the base frame have a dip between the front portion 200 and the rear portion 202 to allow the user to mount and dismount the exercise cycle 10 easily and to permit the user to perform a variety of different leg exercises without hindrance. The upper frame 110 and lower frame 112 may be securely attached by welding or with screws, nuts and bolts, or the like.

As shown in FIG. 2, the rear portion 202 of the base frame 100, preferably on the upper frame 110 may further comprise a seat mount 206 such that a seat 108 or a saddle may be mounted to the seat mount 206. In a preferred embodiment, the seat mount 206 comprises a seat locking member 208. The seat locking member 208 may have a first position and a second position. In the first position the seat locking member 208, for example, a lug or pin, disengages the seat 108, allowing the seat 108 to be adjusted to a desired distance from the crank assembly 102. This allows the user to be a comfortable distance from the crank assembly 102 during the exercise. In the second position the seat locking member 208 may lock the seat 108 in place. In some embodiments the seat locking member 208 may be a retractable lug member, pop pin, or pin and yoke configuration. The seat 108 may comprise a horizontal support bar 210. As shown in FIG. 3, the horizontal support bar 210 comprises a plurality of holes 300, where each recess is shaped to accept the seat locking member 208. In the illustrated embodiment, the seat locking member 208 is spring activated, and releasing the seat locking member 208 causes a compression spring (not shown) to force the seat locking member 208 up towards the horizontal support bar 210 of the seat 108.

Other pin and yoke configurations are equally contemplated, however, within the present invention, including a cog and sprocket arrangement, or alternatively, a threaded pin that requires the user to press the pin into the desired hole, which is tapped with mating threads, and requires twisting the pin into the engaged position in the hole in order to lock the seat 108 into a desired orientation. The pin and yoke combination could also be replaced with a mechanism comprising engaging teeth, or one or many clamping configurations using resistance such as a tightening strap or lever, tactile contact surface, or the like. With such alternatives, the user may select from an endless number of discreet positions.

Figure 3A:
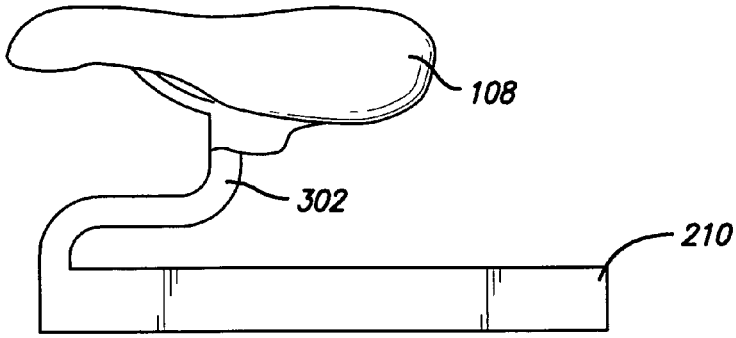
FIG. 3A is a side view of an embodiment of the seat.
Figure 3B:
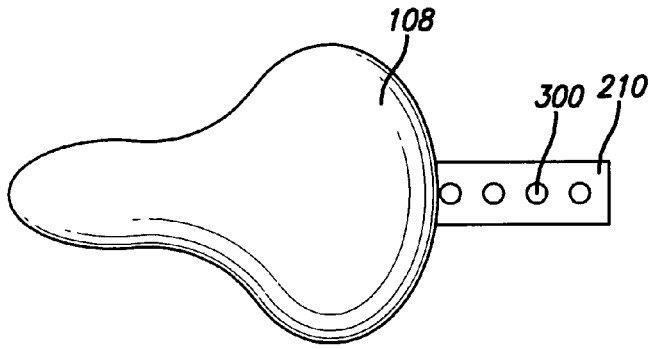
FIG. 3B is top view of an embodiment of the seat.
Figure 3C:
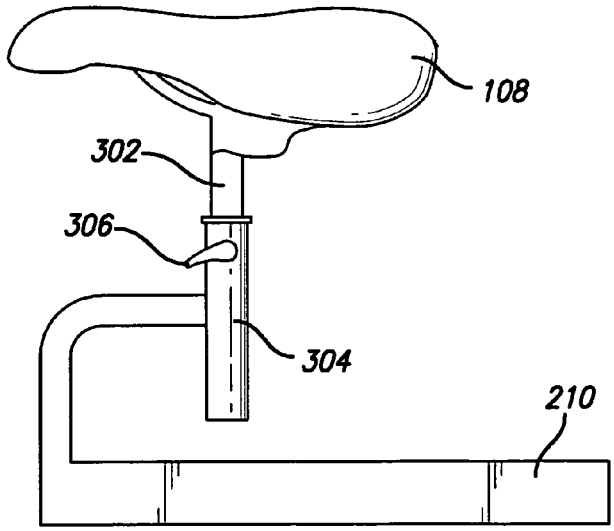
FIG. 3C is a side view of another embodiment of the seat.

The seat 108 may further comprise a vertical support bar 302 as shown in FIGS. 3A and 3C. In some embodiments, the seat 108 comprises a telescoping vertical support bar 302 such that the height of the seat 108 may be adjusted. Similar mechanisms for adjusting the horizontal distance of the seat 108 described above may be employed to adjust the height of the seat 108. The vertical support bar 302 may be any shape.

Figure 4:
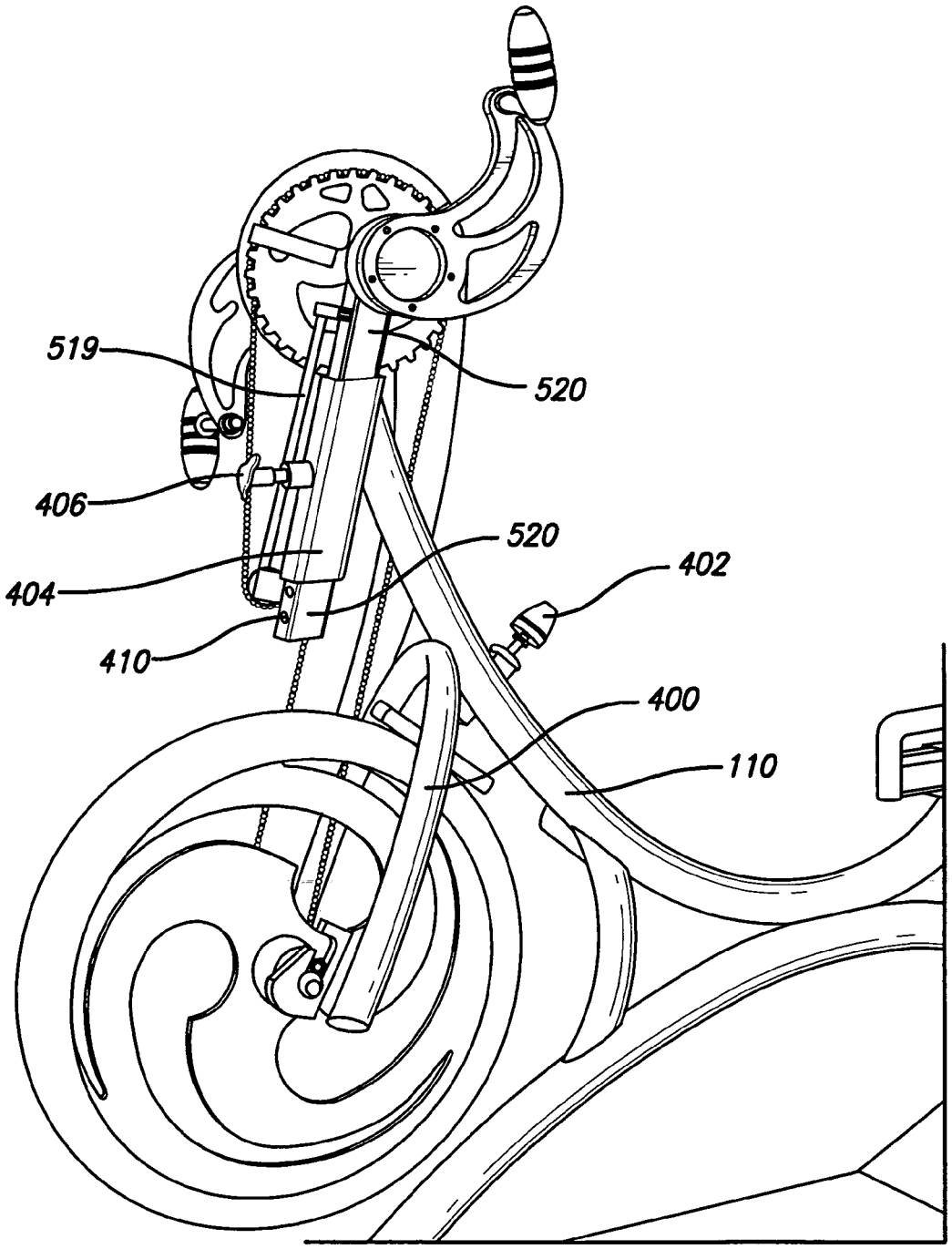
FIG. 4 is a perspective view of another embodiment of a portion of the current invention.

Referring to FIG. 4, the front portion 200 of the frame 100 may further comprise a fork 400, a resistance adjuster 402, and a headstock mount 404.

In a preferred embodiment, the headstock mount 404 comprises a headstock locking member 406 much like the seat locking member 208 and a plurality of recesses 410 substantially the same size as the headstock locking member 406 through which the headstock locking member 406 may be inserted. The headstock locking member 406 may have a first position and a second position. In the first position the locking member, for example, a lug or pin, disengages the head mount, allowing the crank assembly 102 to be adjusted to a desired height. This allows the user to select a desired height to exercise different muscle groups during an exercise. In the second position the head stock locking member may lock the headstock 520 in place. In some embodiments the headstock locking member 406 may be a retractable lug member, pop pin, or pin and yoke configuration. The headstock 520 comprises a plurality of recesses 410, wherein each recess is shaped to accept the headstock 520 locking member. In the illustrated embodiment, the headstock locking member 406 is spring activated, and releasing the headstock locking member 406 causes a compression spring (not shown) to force the headstock locking member 406 through a recess of the headstock 520.

Other pin and yoke configurations are equally contemplated within the present invention, including a cog and sprocket arrangement, or alternatively, a threaded pin that requires the user to press the pin into the desired hole, which is tapped with mating threads, and requires twisting the pin into the engaged position in the hole in order to lock the seat 108 into a desired orientation. The pin and yoke combination could also be replaced with a mechanism comprising engaging teeth, or many clamping configurations using resistance such as a tightening strap or lever, tactile contact surface, or the like. With such alternatives, the user may select from an endless number of discreet positions.

Figure 6:
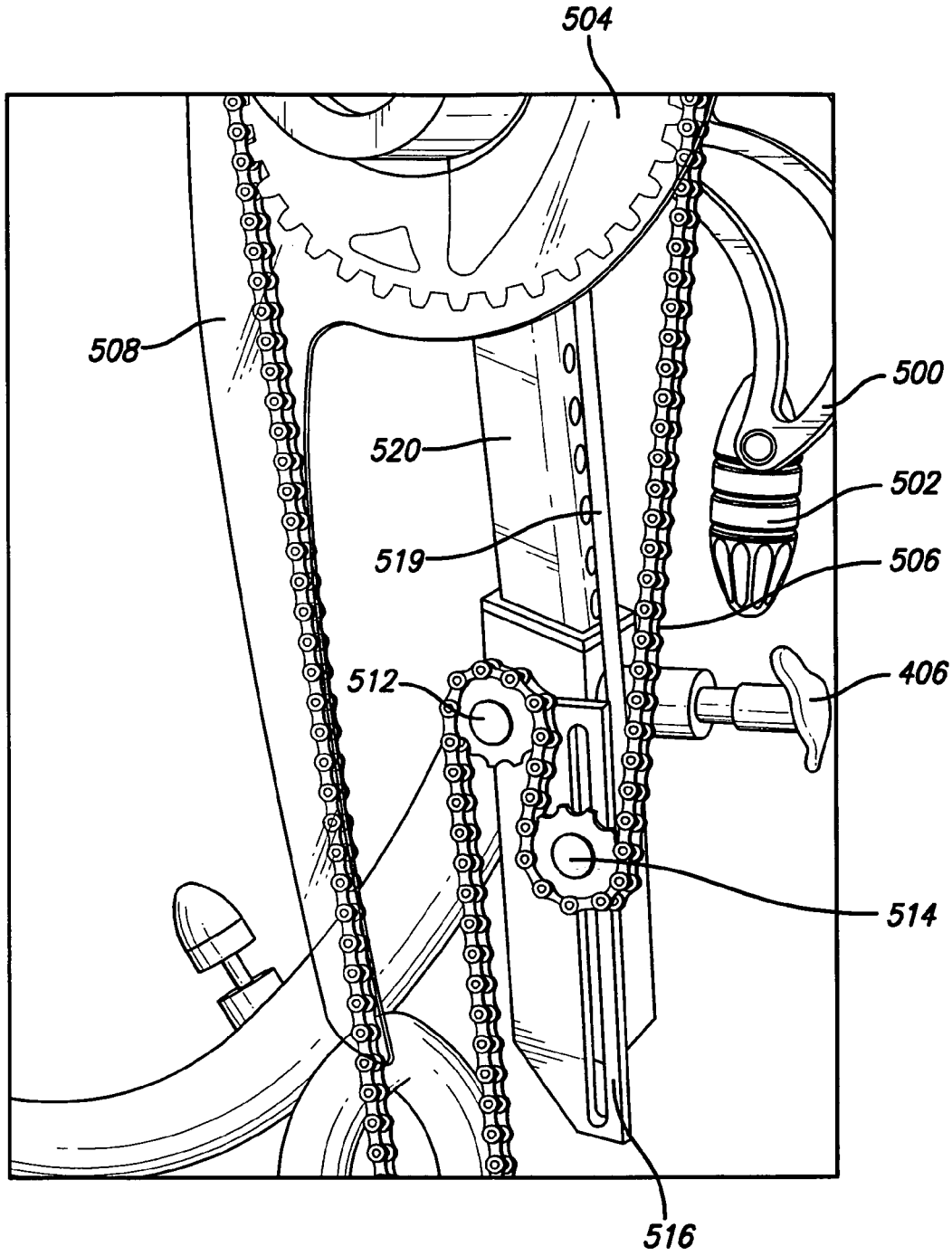
FIG. 6 is a perspective view of an embodiment of a portion of the crank assembly.
Figure 7:
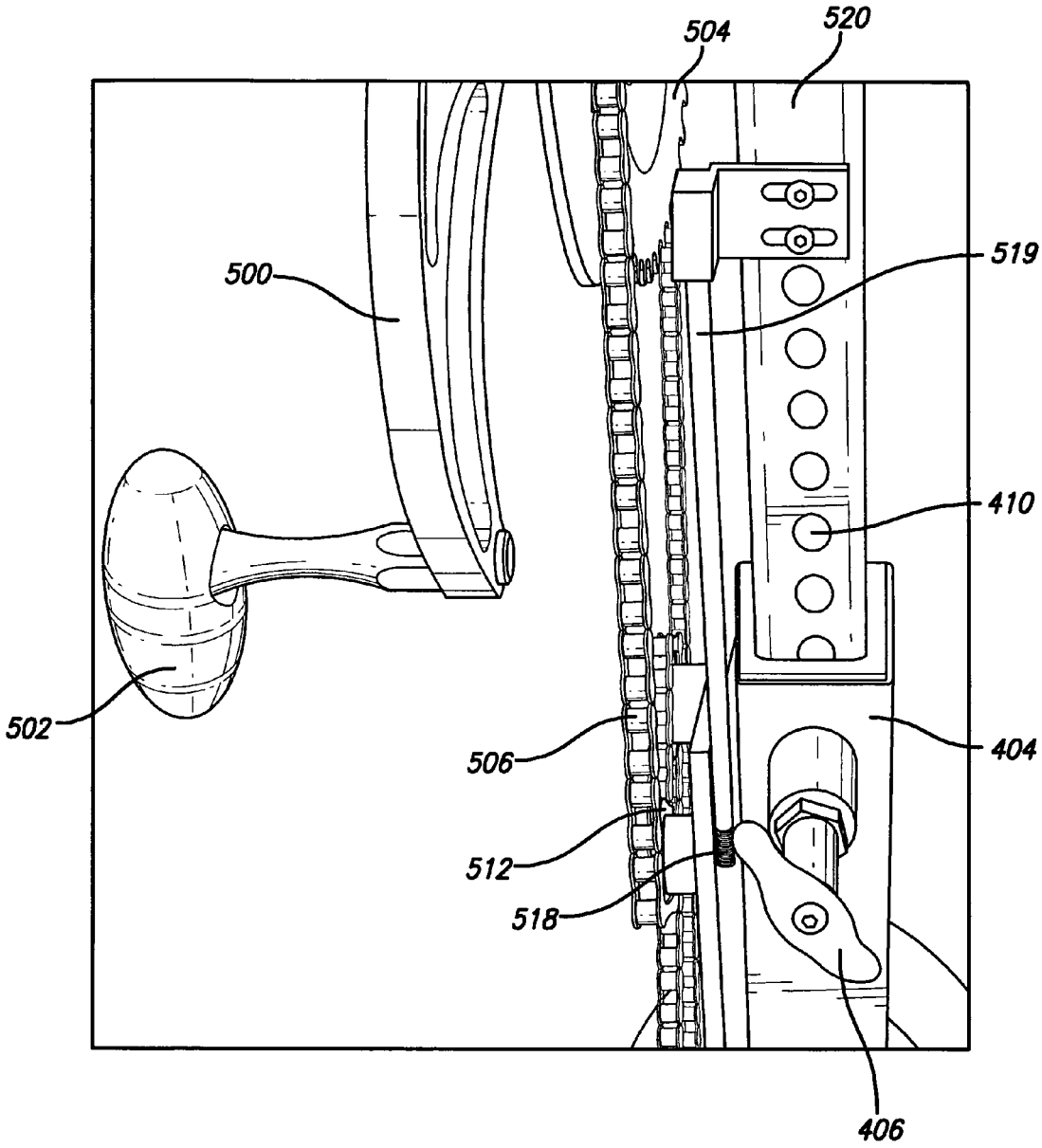
FIG. 7 is a front view of an embodiment of a portion of the crank assembly.
Figure 14:
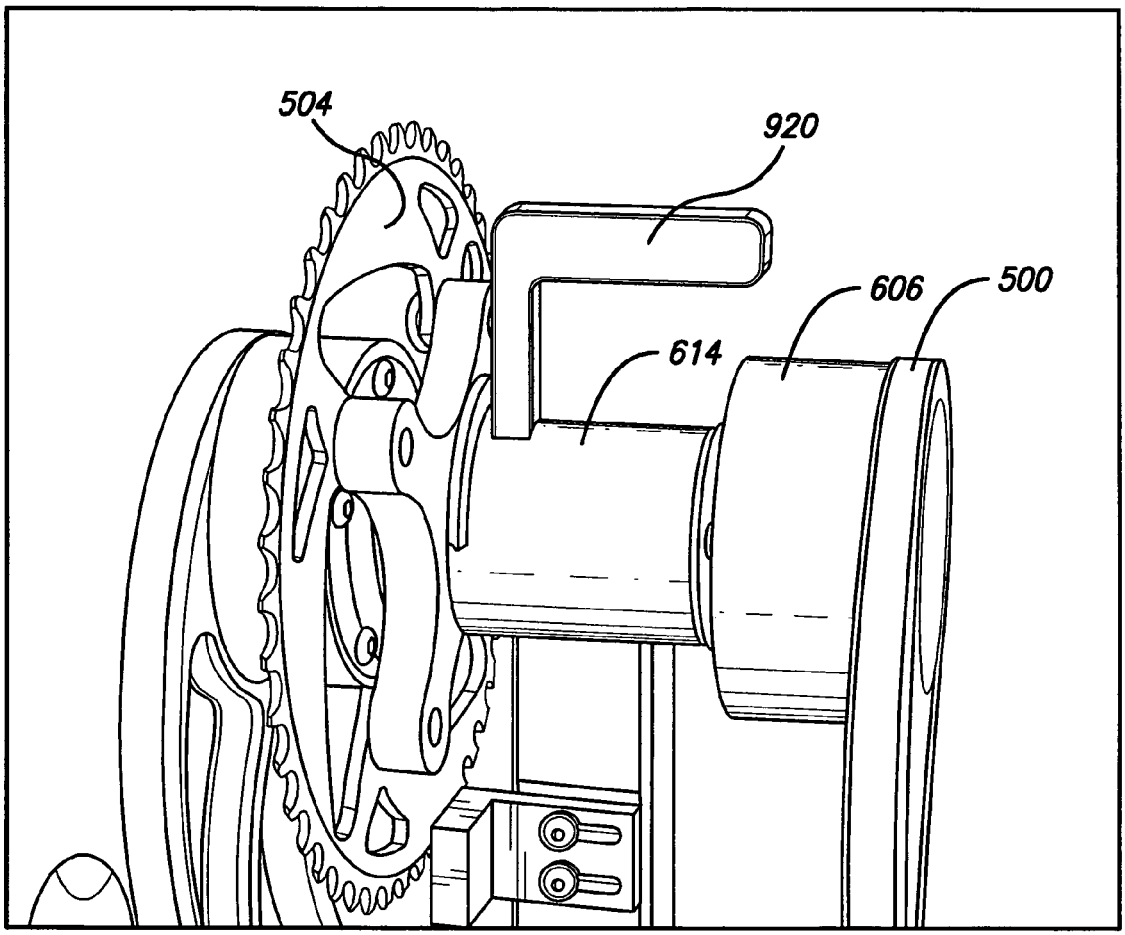
FIG. 14 is a perspective view of an embodiment of a portion of the headstock.

The headstock 520 further comprises the crank assembly 102. The crank assembly 102 comprises a crank arm 500 with a handle 502, a chainring 504, a chain 506, a chain guard 508, and a tension spring mechanism 519 comprising a plurality of pulleys 512, 514, as shown in FIG. 6. The headstock 520 may further comprise a headstock handle 920, as shown in FIG. 14, to facilitate adjusting the headstock to various heights.

Preferably, there are two crank arms 500L, 500R one for the left side and one for the right side. The crank arms 500L, 500R are attached to a crankshaft 600. Each crank arm 500L, 500R may have its own crankshaft 600 or the crank arms 500L, 500R may be attached to the same crankshaft 600. In embodiments where each crank arm 500L, 500R has its own crankshaft 600 each crank arm 500L, 500R may also have its own independent crank assembly 102. Therefore, each crank arm 500L, 500R will have its own chainring 504, chain 506, and chain guard 508. Each crank arm 500L, 500R may also have its own tension spring mechanism 519. In such an embodiment, the flywheel 104 will have a left and right chainring for each crank assembly 102. The left and right chainring may be independent from each other so that rotation of one chainring will not affect the rotation of the other chainring. This provides a mechanism for allowing the left and right crank arms 500L, 500R to be independent from the other. This may be accomplished by using a ratchet and pawl mechanism, a clutch system, a bearing mechanism or any other mechanism that allows for freewheeling.

Figure 8:
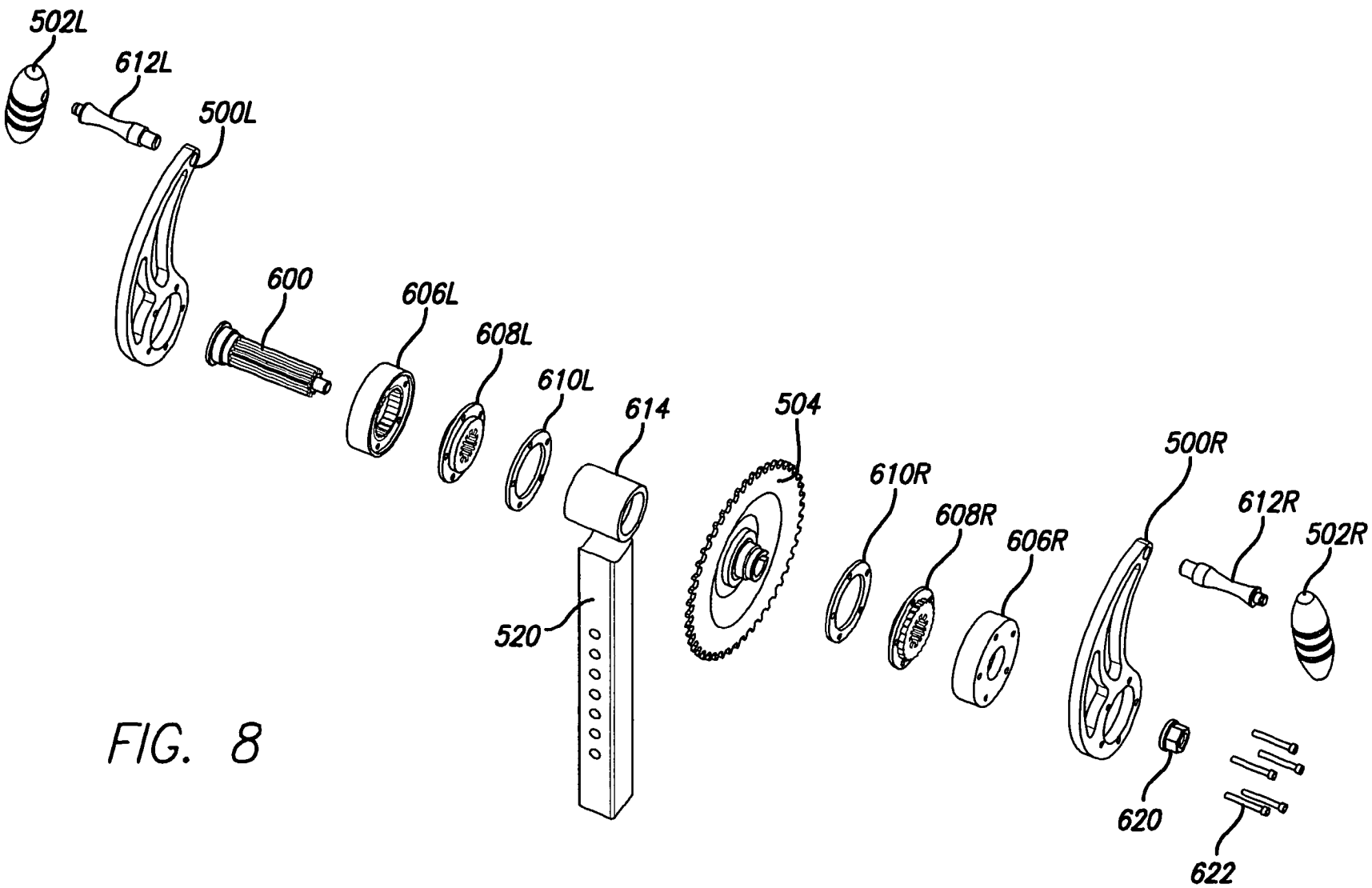
FIG. 8 is an exploded view of an embodiment of the crank assembly parts.
Figure 9:
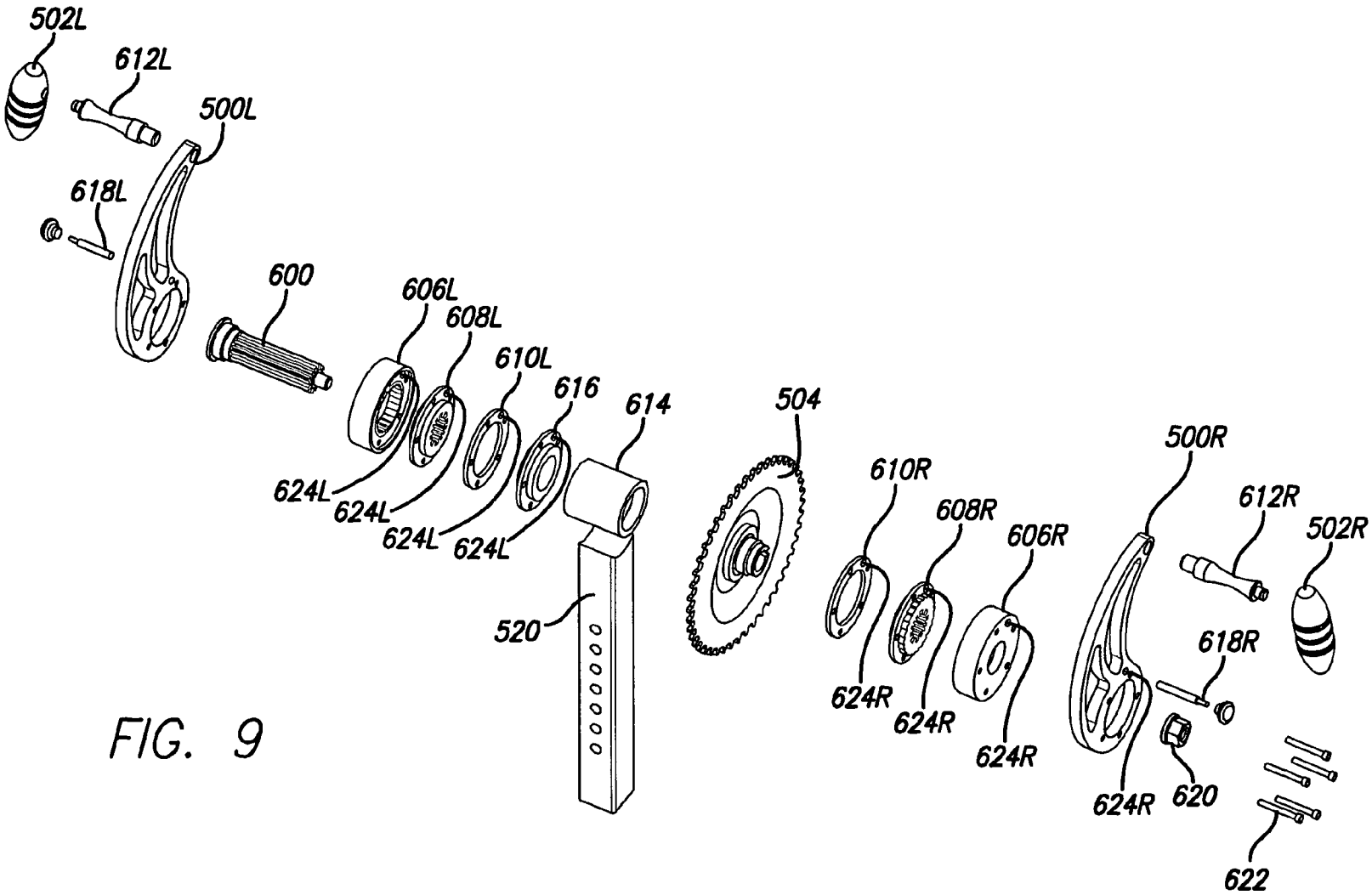
FIG. 9 is an exploded view of another embodiment of the crank assembly parts.
Figure 10:
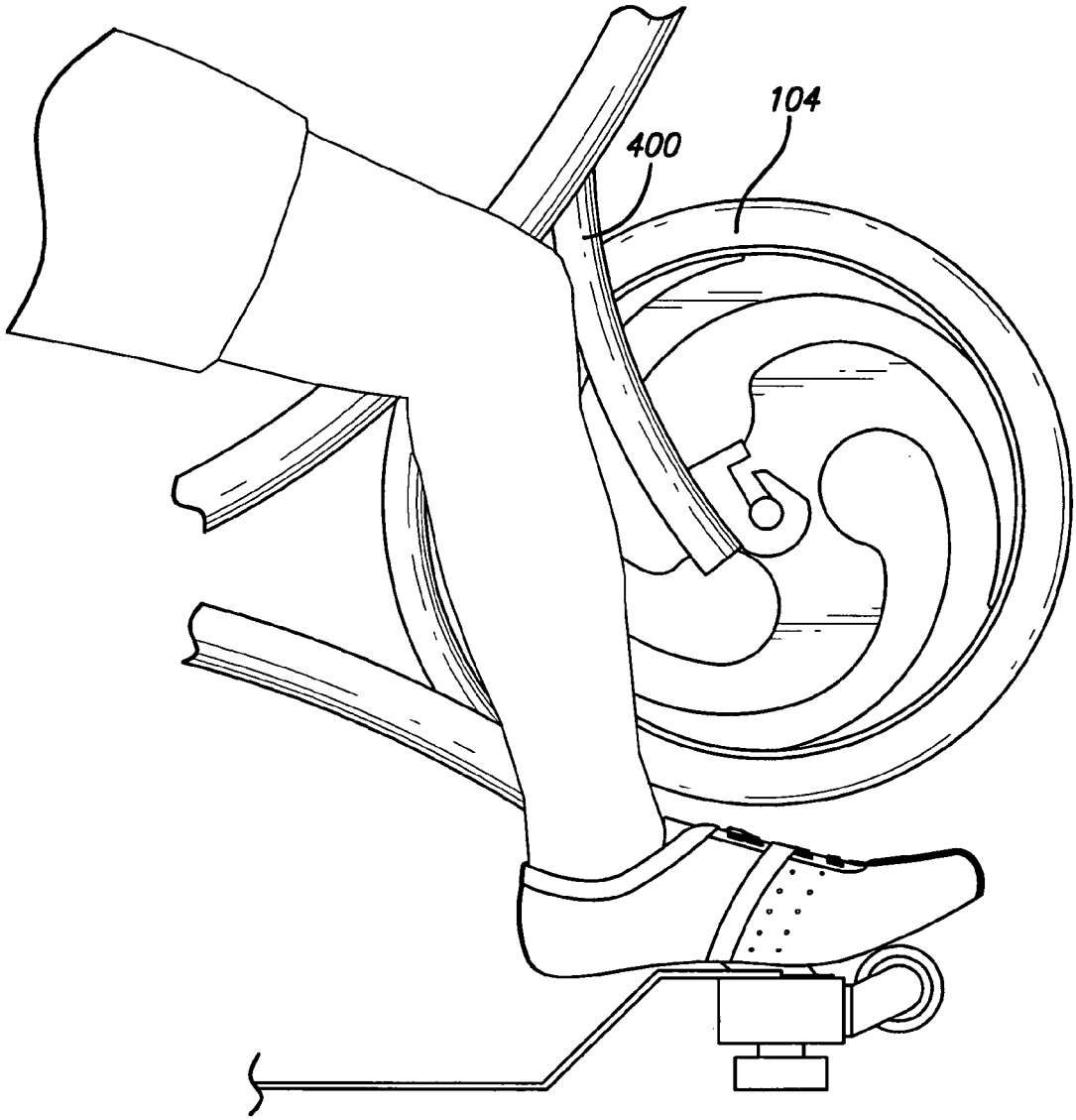
FIG. 10 is a side view of an embodiment of the front portion of the invention.
Figure 11:
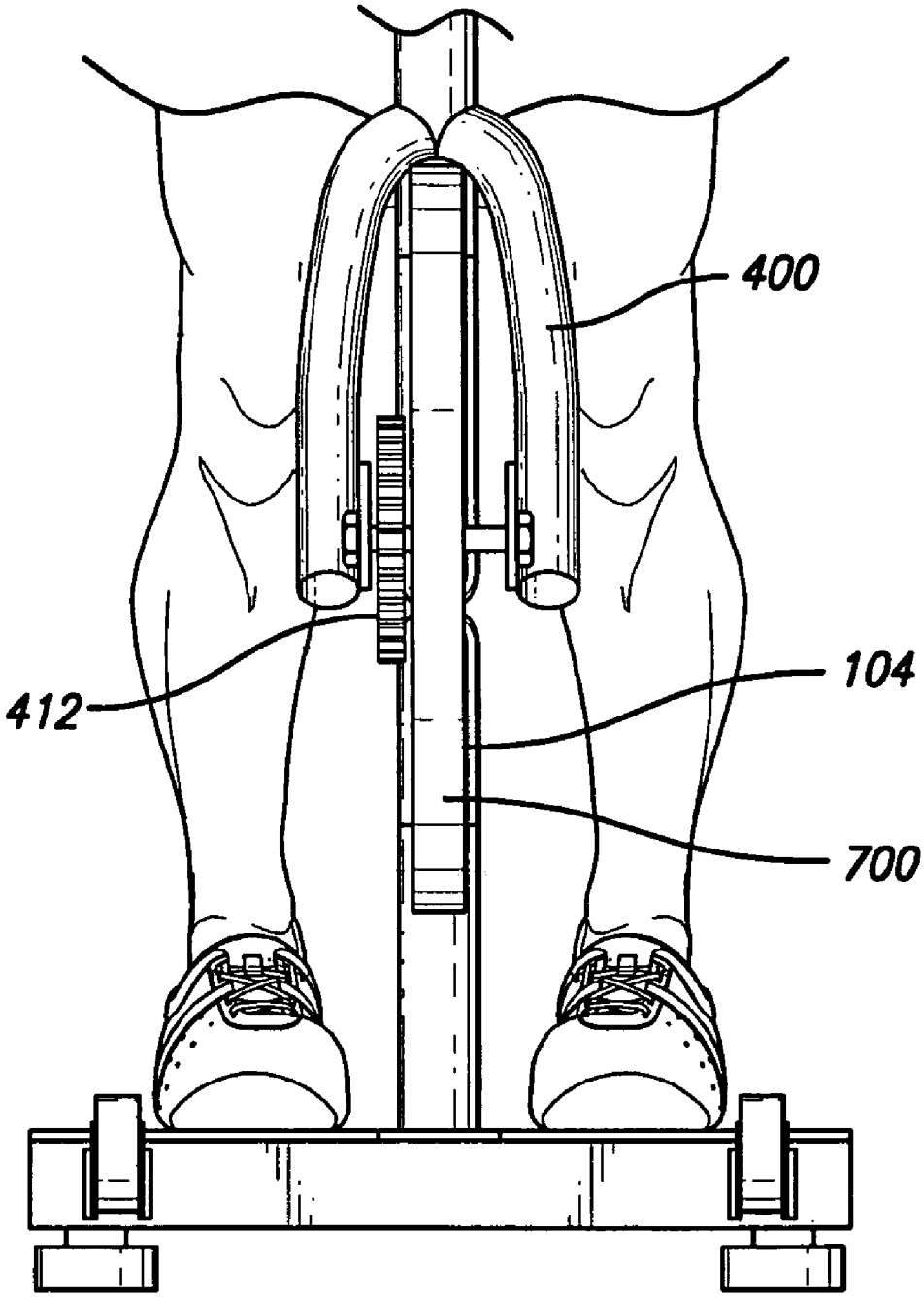
FIG. 11 is a front view of an embodiment of a portion of the invention.

As shown in FIG. 8, in some embodiments where crank arms 500L, 500R share a single crankshaft 600, the crank assembly comprises crank arms 500L, 500R, handles 502L, 502R connected to the respective crank arms 500L, 500R by handle adapters 612L, 612R, freewheel holders 606L, 606R connected to the respective crank arms 500L, 500R, freewheels 608L, 608R connected to the respective freewheel holders 606L, 606R in a ratchet and pawl configuration, clamp rings 610L, 610R connected to the respective freewheels 608L, 608R and a chainring 504 connected to a clamp ring 610R on one side of a crankshaft housing 614. The crankshaft 600 extends from one crank arm 500L to the other crank arm 500R. The chainring 504, and freewheels 608L, 608R are keyed to the crankshaft 600 such that rotation of the crankshaft will cause rotation of the chainring 504 and freewheels 608L, 608R.

This system allows either crank arm 500L, 500R to independently turn the chainring 504 to drive the flywheel 104. For example, the left crank arm 500L may be held in place while the right crank arm 500R is rotated. Rotation of the right crank arm 500R in a forward direction, relative to the user, will cause the freewheel holder 606R to catch the freewheel 608R and cause freewheel 608R to rotate. Rotation of the freewheel 608R will cause the crankshaft 600 to rotate in the forward direction, thereby, driving the flywheel 104. Rotation of the crankshaft 600 causes freewheel 608L to rotate in the forward direction. However, rotation of freewheel 608L does not catch freewheel holder 606L, therefore, freewheel holder 606L does not rotate and crank arm 500L does not rotate. Conversely, rotation of crank arm 500L in a first direction will cause freewheel holder 606L to rotate. Rotation of freewheel holder 606L will catch freewheel 608L which will cause crankshaft 600 to rotate. Rotation of crankshaft 600 will cause chainring 504 and freewheel 608R to rotate. However, in this situation, rotation of 608R will not cause freewheel holder 606R to rotate, therefore, crank arm 500R will also not rotate.

The crankarms 500L, 500R may also be locked such that they are dependent on each other. This may be accomplished adding an indexing ring 616 to the side opposite the chainring 504 and adding crank arm locking members 618L, 618R. For example, the indexing ring 616 may be inserted between the clamp ring 610L and the crankshaft housing 614. The indexing ring is keyed to the crankshaft 600 such that rotation of the crankshaft 600 will cause rotation of the indexing ring 616. The indexing ring 616 has an aperture 624L to accept crank arm locking member 618L. The aperture 624L may be on either side of the crankshaft housing. Preferably the indexing ring 616 has a plurality of apertures 624L positioned circularly around the perimeter of the indexing ring 616 so that the crank arms 500L, 500R may be locked in position in different orientations. For example, the crank arms 500L, 500R may be locked at zero degrees so that they are in the same position, crank arm 500L, 500R may be locked at 90 degrees, crank arms 500L, 500R may be locked at 180 degrees so that they are in opposite positions, or at any other angle as desired by the user.

Crank arm locking member 618L is located on crank arm 500L and extends through freewheel holder 606L, freewheel 608L, and clamp ring 610L through aperture 624L to connect with indexing ring 616. A second crank arm locking member 618R is located on crank arm 500R and extends through freewheel holder 606R, freewheel 608R and clamp ring 610R through aperture 624R. Essentially, the indexing ring 616 is disabling the freewheeling capability.

The crank arm locking members 618L, 618R have a first position and a second position. In the first position the crank arm locking members are engaged with the crank assembly parts and in the second position the crank arm locking members 618L, 618R are disengaged from the crank assembly parts. In operation, the crank arm locking member 618R is placed in the second position. The crank arm 500R is then rotated until the crank arm locking members 618R is aligned with the aperture 624R of the freewheel holder 606R, freewheel 608R, and clamp ring 610R. The crank arm locking member 618R may then be placed in the first position to lock it in the aperture 624R. Crank arm locking member 618L may be similarly used to lock crank arm 500L.

In a preferred embodiment, the handles 502L, 502R are ergonomically shaped to allow the users to grip the handles 502L, 502R such that the palms would be facing towards each other. The handles 502L, 502R may also be positioned such that the palms may be faced up or down when gripping the handles 502L, 502R. The handles 502L, 502R may also be made adjustable such that the hands may be placed in a variety of different positions to facilitate isolating specific muscle groups. The handles 502L, 502R are also freely rotatable about an axis protruding orthogonally from the flat surface of the crank arm 500 where the handles 502L, 502R are attached. This allows the hands to maintain the same orientation during a full revolution of the crank arm 500.

The chainring 504 may be a standard chainring 504 or sprocket with projecting teeth to catch a chain 506 such as a roller chain to rotate the flywheel sprocket 412 to drive the flywheel 104. In another embodiment belts, cables, and the like in conjunction with pulleys may be used to drive the flywheel 104. In another embodiment a plurality of gears may be used to drive the flywheel 104. In another embodiment, two chainrings 504, one for each crank arm 500, may be used to drive the flywheel 104. In another embodiment, the exercise cycle 10 may have two independent flywheels 104 driven separately by two different crank arms 500. In another embodiment, the flywheel 104 may be driven by friction bands, belts, cogs, and the like.

Figure 15A:
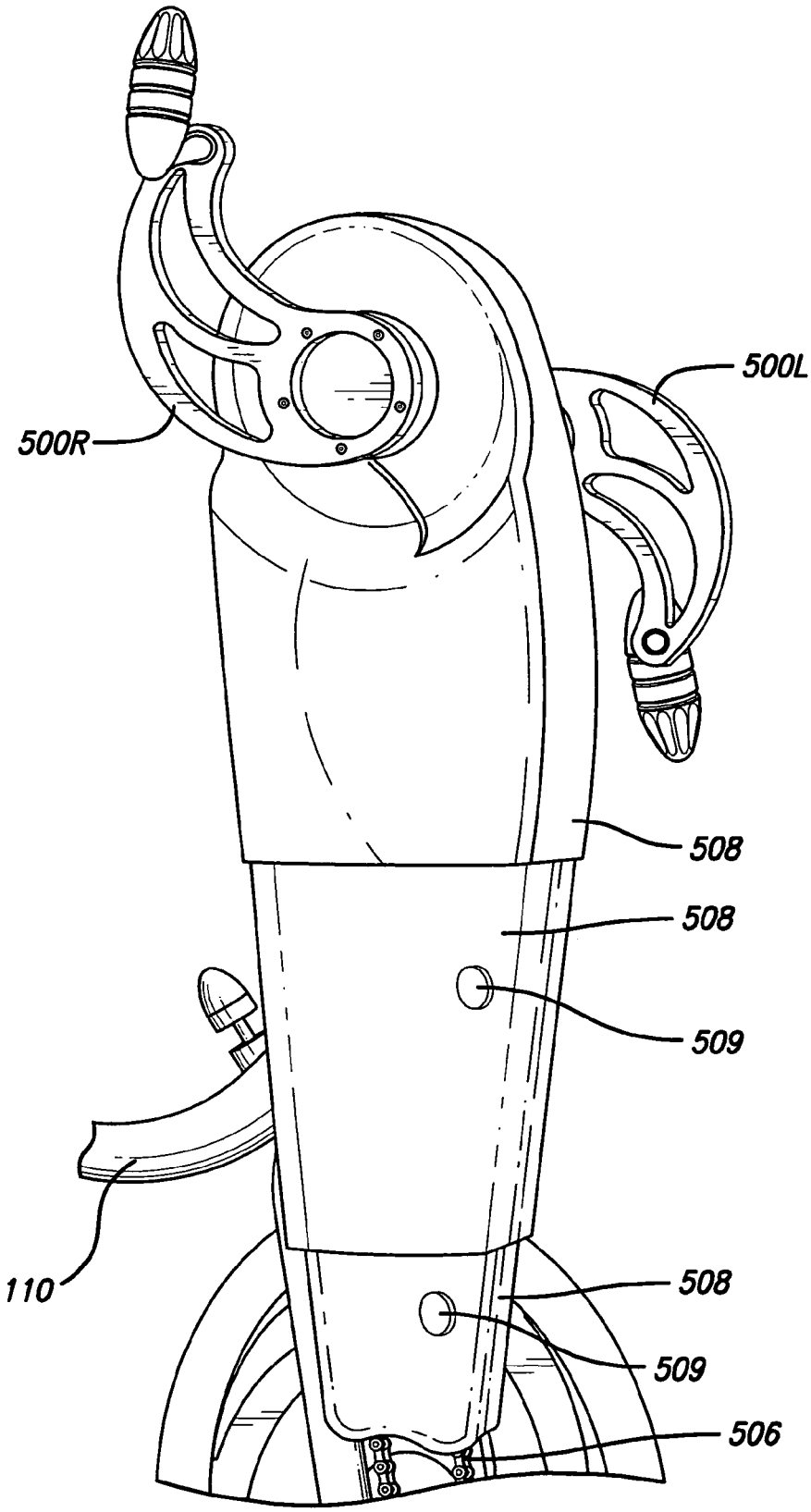
FIG. 15A is a perspective view of an embodiment of a chainguard.
Figure 15B:
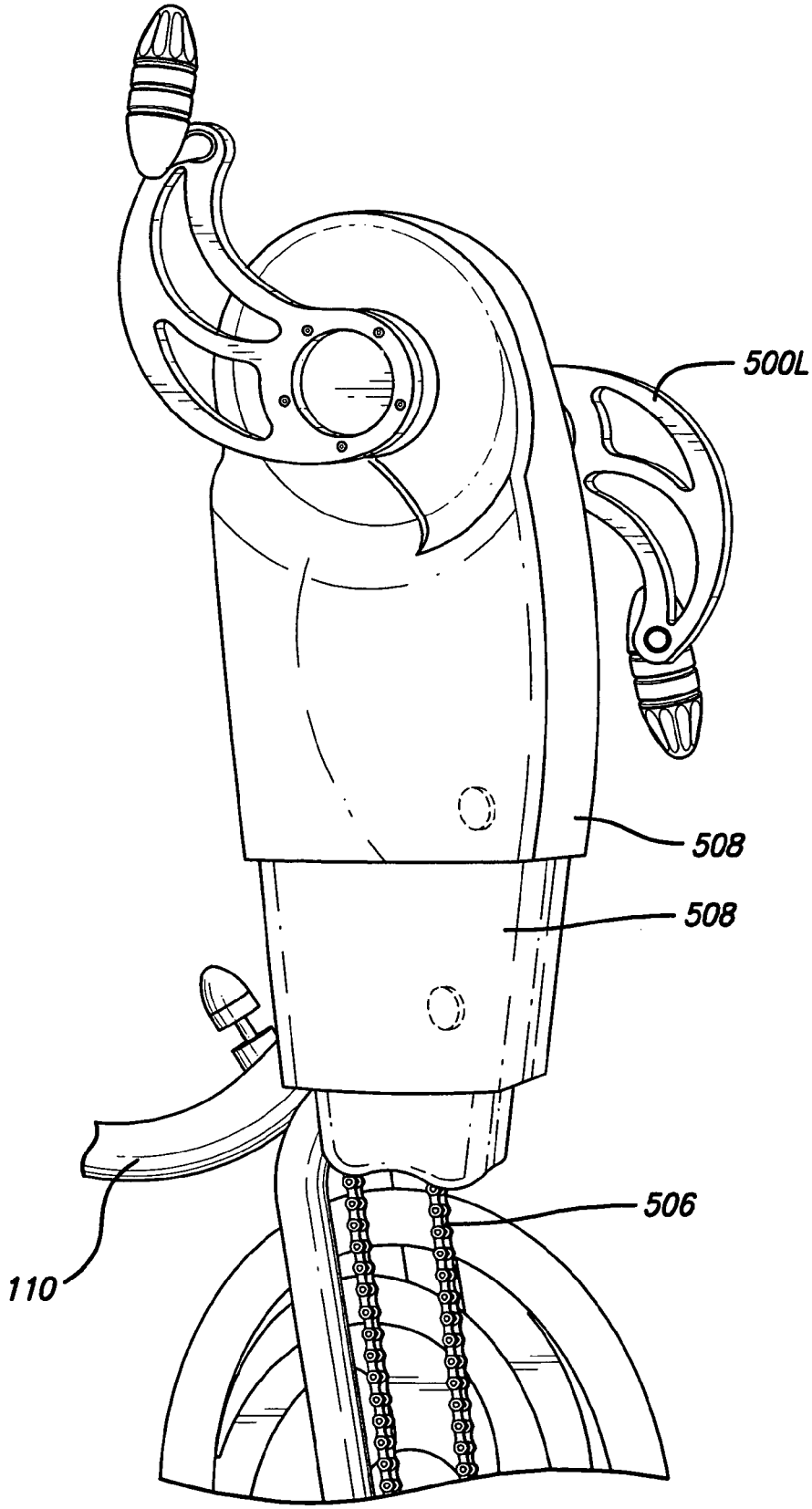
FIG. 15B is a perspective view of chainguard shown in FIG. 15A in a collapsed configuration.

The chainguard 508 is used to protect the user from getting any body parts, clothing, or other objects caught in the chainring 504. The chainguard may be attached to one side of the chainring 504 or both sides of the chain ring. In some embodiments, as shown in FIGS. 15A and 15B, the chainguard 508 may be adjustable or telescoping so that the chain may be exposed or covered. The chainguard 508 may have a catch mechanism 509 such that when the chainguard 508 is collapsed, the catch mechanism 509 catches a receiver, such as an indentation, on the chainguard 509 to hold the chainguard in the collapsed configuration.

The tension spring mechanism 519 allows the crank assembly 102 to be adjusted to various heights while maintaining tension on the chain 506 or belt. The tension spring mechanism 519 comprises at least two pulleys, a fixed pulley 512 and a tension pulley 514. The fixed pulley 512 is fixed in one position on a pulley mount 516. The tension pulley 514 is slidably coupled to the pulley mount 516 and maintains a tension in the chain 506 as the height of the crank assembly 102 is adjusted. The tension pulley 514 is fixedly secured to the headstock 520 by a tension pulley 514 support. In the preferred embodiment, a spring 518 forces the tension pulley 514 downward. The crank assembly 102 may be lifted by raising the headstock 520. This causes the tension pulley 514 support to rise up. Since, the tension pulley 514 support is connected to the tension pulley 514, the tension pulley 514 also rises. Due to the spring 518, however, a downward force is constantly applied to the tension pulley 514, thereby, maintaining the tension in the chain 506. When the crank assembly 102 is lowered, the spring 518 again forces the tension pulley 514 downward to maintain the tension.

In another embodiment, the height of the headstock 520 may be adjusted by rotatably coupling the headstock 520 mount to the front portion 200 of the upper frame 110. This provides a means for rotating the crank assembly 102 downward toward the user.

In addition, combining the tension spring mechanism 519 with the rotating headstock 520 mount provides greater range or positions for the crank assembly 102 by providing a means to adjust the crank assembly 102 in a vertical and horizontal direction. For example, the user may lift the crank assembly 102 to its maximum height, then rotate the head mount 90 degrees to bring the crank assembly 102 lower and closer to the seat 108.

In one embodiment, the pivot point for providing the means for rotating the head mount is at the point where the head mount meets the front portion 200 of the upper frame 110. In another embodiment, the pivot point is at the point approximately where the front portion 200 of the upper frame 110 meets the fork 400. When the pivot point is at the point approximately where the front portion 200 of the upper frame 110 meets the fork 400, the crank assembly 102, headstock mount 404, fork 400 and flywheel 104 would all be able to rotate together.

The height-adjustable head stock allows a variety of different muscle groups to be exercised. In addition, it allows the user to exercise while standing or sitting. Furthermore, it allows users of different heights to use the exercise cycle 10 or by those who may be bound in a wheel chair.

Figure 5:
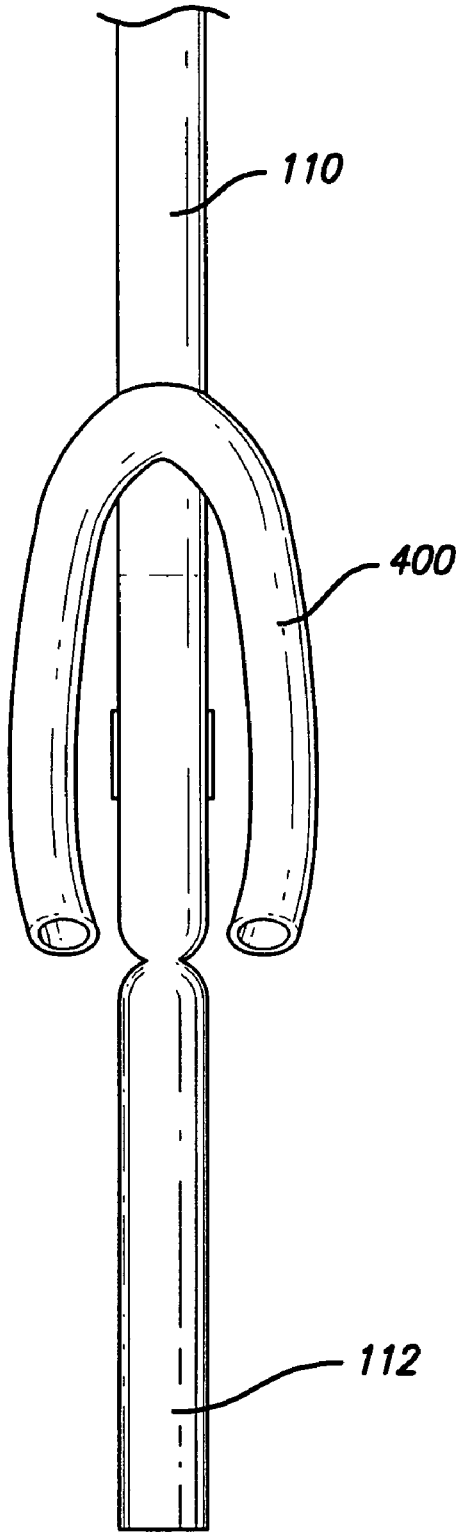
FIG. 5 is a front view of an embodiment of a portion of the frames.

The upper frame 110 also comprises a fork 400 to hold the flywheel 104. In the preferred embodiment, the fork projects downward from the upper frame 110 and is angled away from the upper frame 110. When viewed from the front, as shown in FIG. 5, the fork 400 has the appearance of a thin, upside down "U." The ends of the fork 400 are removably coupled to the hub 802 of the flywheel 104. Therefore, in general the length of the fork 400 is slightly larger than the radius of a flywheel 104. In a preferred embodiment, the ends of the fork 400 do not project beyond the hub 802 of the flywheel 104. This allows the user to place his/her leg on the base plate ramp 106 without being hindered by the fork 400. In addition, the fork 400 should be angled away from the upper frame 110 sufficient enough to prevent the flywheel 104 from coming in contact with the upper frame 110.

In another embodiment, the fork 400 may also be telescoping to accommodate different sizes of flywheels 104. The same mechanisms described for the adjustable headstock 520 and seat 108 may be employed for an adjustable fork 400. In another embodiment, the fork 400 may project upwards from the front portion 200 of the lower frame 112 to support the flywheel 104.

The flywheel 104 provides the resistance to the rotation of the crank arms 500 to produce the exercise. One method of increasing the resistance in the crank arms 500 is to increase the mass of the flywheel 104, particularly towards the rims 800. This may be accomplished by providing flywheels 104 of different weight. To facilitate changing the flywheel 104, the flywheel 104 may be secured to the fork 400 with a quick-release bolt utilizing a cam mechanism. Alternatively, or in conjunction, the flywheel 104 may be designed such that a weight may be added to the flywheel 104 in increments. For example, the flywheel 104 may be comprised of a rim 800, a hub 802, and a plurality of spokes 804. The flywheel 104 may be designed such that weights may be incrementally added between the plurality of spokes 804 to incrementally increase the mass of the flywheel 104. For example, the inner rim 800 and the spokes 804 may have grooves and the weights may have tongues or projections. The weights may then be inserted or fitted and secured in between the inner rim 800 and the spokes 804 in a tongue and groove configuration. The weights may also have grooves such that additional weights may be further added to a previously added weight so as to incrementally increase the mass of the flywheel 104. Other methods of securing weights to the rim 800 and/or spokes 804 may be used such as clamps, screws, fasteners, pins, locking members and the like.

The flywheel may be made of any type of material such as metal, plastic, carbon fiber, and titanium. Preferably, the flywheel is made from cast iron.

The exercise cycle 10 may further comprise a truing mechanism to balance the flywheel 104.

The upper frame 110 further comprises a resistance adjuster 402. The resistance adjuster 402 comprises a knob 806 and a resistance pad 808. Rotating the knob 806 in one direction causes the resistance pad 808 to apply a force upon the flywheel 104, thereby creating a sliding resistance. By continuing to rotate the knob 806 in the same direction more force may be applied to the flywheel 104 by the resistance pad 808, thereby, increasing the resistance between the flywheel 104 and the resistance pad 808. Thus, more force is required to turn the crank arms 500 to continue to rotate the flywheel 104. The resistance pad 808 may be leather, felt, plastic, rubber, cork, or other material that would not be abrasive to the flywheel 104 but provide resistance. Preferably the resistance pad 808 is a hard, felt material. More preferably, the resistance pad 808 is made of leather. The resistance pad 808 should be removably secured to a brake shoe 810, which is coupled to the brake knob sob. This will allow the resistance pads 808 to be replaced when the resistance pad 808 runs thin.

Figure 12:
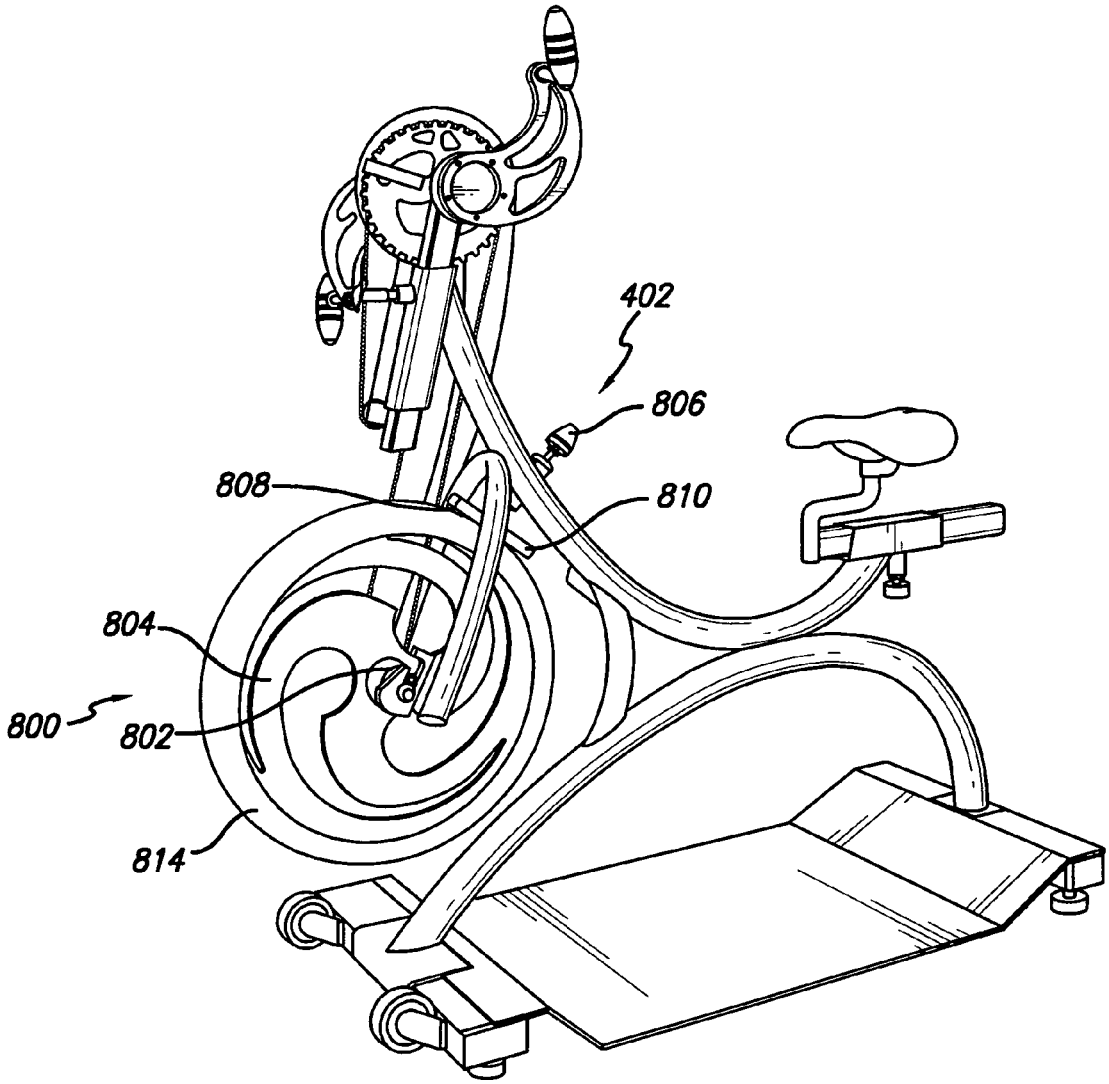
FIG. 12 is a perspective view of an embodiment of a portion of the invention.

As shown in FIG. 12, the resistance pad 808 is applied to a top surface 812 of the flywheel 104. The resistance pad 808 may also be applied to a side surface 814 singly or bilaterally to both side surfaces 814 or a combination of the side surface 814 and the top surface 812 of the flywheel 104.

Mean for generating resistance in the flywheel 104 may also be generated by magnetic brakes. The flywheel 104 may be made of a metal with magnetic properties. A magnet, such as an electromagnet may be placed adjacent to or partially or completely surrounding the flywheel 104. The resistance on the flywheel 104 would be determined by the strength of the magnetic field which may be adjusted. In another embodiment, the crank arms 500 may be coupled to an electric generator, which in turn is coupled to an electromagnet. The magnetic force would then be commensurate with the speed of rotation of the crank arms. This causes the resistance to automatically change with the speed of the crank arm 500 or flywheel 104. Many other braking systems may be employed to create resistance in the flywheel 104 including, a computer system to control the resistance electronically.

The lower frame 112 comprises a front portion 200, a rear portion 202, and a downward elliptical bend 904. Although the lower frame 112 is illustrated with a downward elliptical bend 904, the lower frame 112 may be many different shapes. For example, the lower frame 112 may be parabolic, semicircular, square, or v-shaped (inverted). In a preferred embodiment, the lower frame 112 may be mounted on the base plate ramp 106. However, the lower frame 112 may comprise support bars 906, support feet, or other structures to provide support and stability.

Figure 13:
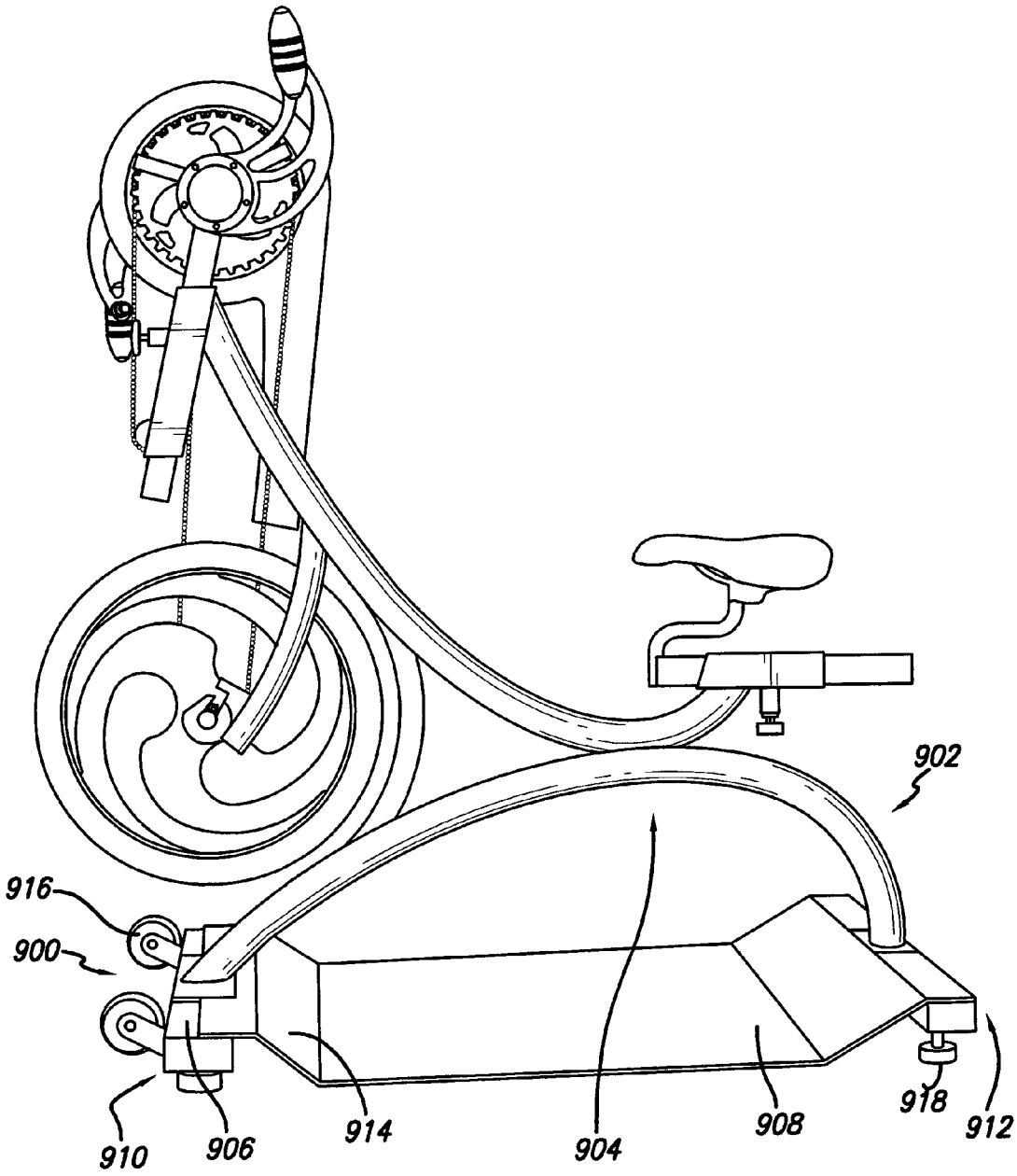
FIG. 13 is a side view of an embodiment of the invention.

As shown in FIG. 13, the base plate ramp 106 comprises a flat base 908, a front end 910, and a back end 912. In a preferred embodiment, the front end 910 and the back end 912 may be raised up off the ground. The flat base 908 may gradually approach the raised position at the front and back ends 912 like a ramp. The front end 910 of the base plate ramp 106 may further comprise at least one wheel. Preferably the front end 910 of the base plate ramp 106 comprises two wheels 916. The base plate ramp 106 may be approximately 24 inches long to approximately 75 inches long. Preferably, the base plate ramp 106 is between approximately 36 inches long to approximately 50 inches long.

The wheels 916 provide a means for easily moving or transporting the exercise cycle 10. In a preferred embodiment, when the exercise cycle 10 is in use the wheels 916 would be slightly off the ground since the ends of the base plate ramp 106 are elevated. To move or relocate the exercise cycle 10, the user may lift the back end 912 of the exercise cycle 10 by lifting the lower frame 112. This places the wheels 916 on the ground allowing the user to roll the exercise cycle 10. In another embodiment, the wheels 916 may be placed on the back end 912 of the base plate ramp 106.

The back end 912 of the base plate ramp 106 may comprise support pads 918. Preferably, the support pads 918 are located at the left and right corners of the back ends 912 of the base plate ramp 106. The support pads 918 may be adjustable such that the height of the back end 912 of the base plate ramp 106 may be elevated or lowered so that the exercise cycle 10 may be properly balanced. In another embodiment, the support pads 918 may be located on the front end 910 of the base plate ramp 106.

In another embodiment, the upper frame 110 and lower frame 112 may be truncated to half its length by removing or making removable the rear portions 202. Rather than providing an elliptical upward or lower bend, the upper 110 and lower frames 112 may be bent straight downward and secured into the middle of the base plate ramp 106. This provides a clearance for which a disabled person in a wheelchair could fit and use the upper body exercise cycle 10. In another embodiment, a ramp may be placed above the seat 108 or replace the seat 108. This ramp may provide a platform for a person in a wheelchair to roll up onto so as to be at the proper height and distance to reach the crank arms 500L, 500R. The ramp may also have means to secure the wheelchair to prevent the wheelchair from rolling off during the exercise. For example, the ramp may have divets or indentations for the wheelchair wheels to fall into to prevent the wheelchair wheels from rolling off the ramp. Alternatively, the ramp may utilize clamps or straps and the like to secure the wheelchair onto the ramp.

In use, a user may first adjust the seat 108 to the proper height and distance from the crank arms 500. The user may then adjust the height of the headstock 520 to isolate a particular set of muscles. The user may adjust the amount of resistance desired on the flywheel 106. The user may then select the type of exercises to perform. With the upper body exercise cycle the user may engage in a "double", where both crank arms 500L, 500R are placed in the same position and rotated simultaneously in synchrony. Alternatively, the user may engage in the "independent right" or the "independent left" where only the left or right crank arm 500R is rotated, thereby isolating a specific muscle group on one side. In addition, the user may engage in split motion cranking, where the crank arms 500L, 500R are opposite each other like the pedals of a bike. In addition, the crank arms 500L, 500R may form any angle from zero to three hundred sixty degrees.

Finally, the user may stand in front of the exercise cycle 10, facing towards it, and then rotate the crank arms 500L, 500R towards him. Since the user is standing in front of the exercise cycle 10 he would have to rotate the crank arms 500L, 500R in the opposite direction than when he is sitting on the seat 108 behind the exercise cycle 10. This will focus on a different group of muscles.

In some embodiments, the fork 400 may be attached to a vertical frame comprising a swivel lock. The swivel lock may be disengaged to allow the fork 400 to swivel in a forward or backward direction. This facilitates the use of the exercise cycle 10 from different sides by allowing the user to move the flywheel 104 away from him or her depending on which side of the exercise cycle 10 the user wants to stand.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. An exercise equipment, comprising:

a. a base frame comprising a front portion and a rear portion;

b. a flywheel rotatably connected to the base frame;

c. a crank assembly attached to the base frame, wherein the crank assembly comprises:

i. a crankshaft housing;

ii. a crankshaft housed inside the crankshaft housing;

iii. a first and a second crank arm mounted on the crankshaft on opposite sides of the crankshaft housing;

iv. a first and a second freewheel holder mounted on the crankshaft on opposite sides of the crankshaft housing and attached to the first and second crank arm, respectively;

v. a first and a second freewheel mounted on the crankshaft on opposite sides of the crankshaft housing and coupled to the first and second freewheel holder, respectively, in a ratchet and pawl configuration to allow the first and second crank arms to drive the flywheel independently;

vi. a chainring mounted on the crankshaft on one side of the crankshaft housing and fixedly attached to the second freewheel; and vii. a drive chain coupled to the chainring and the flywheel, wherein the first and second freewheels and the chainring are keyed to the crankshaft such that rotation of the crankshaft by the first or second crank arm in a first direction rotates the first or second freewheel, respectively, and the chainring, thereby allowing the first and second crank arms to independently turn the chainring to turn the drive chain and drive the flywheel;

d. an indexing ring on a side opposite the chainring inserted between the crankshaft housing and the first freewheel, wherein the indexing ring is keyed to the crankshaft such that rotating the crankshaft rotates the indexing ring, wherein the indexing ring comprises an aperture; and e. a first and a second crank arm locking member insertable into the aperture, wherein the first and second crank arm locking members each have an engagement position and a disengagement position, wherein in the engagement position the first and second crank arm are immobilized relative to each other and in the disengagement position the first and second crank arms are independent of each other.

2. The exercise equipment of claim 1, further comprising a. a headstock mount attached to the base frame further comprising a headstock locking member;

b. a headstock mounted in the headstock mount and configured to receive the crank assembly, the headstock further comprising a plurality of recesses, wherein each recess is shaped to accept the headstock locking member so as to adjust a height of the headstock; and c. a tension spring mechanism attached to the headstock, the tension spring mechanism comprising a plurality of pulleys to maintain a tension on a chain while the height of the headstock is adjusted.

3. The exercise equipment of claim 1, wherein the crank assembly further comprises a chainguard.

4. The exercise equipment of claim 3, wherein the chainguard is adjustable to expose or cover the drive chain.

5. The exercise equipment of claim 1, further comprising a base plate ramp.

6. The exercise equipment of claim 1, wherein the indexing ring comprises a plurality of apertures to allow the first and second crank arms to be immobilized relative to each other in a plurality of positions.

7. The exercise equipment of claim 1, wherein the base frame comprises a. an upper frame comprising an upward elliptical bend; and b. a lower frame mounted on a base plate ramp, wherein the lower frame comprises a downward elliptical bend.

8. The exercise equipment of claim 1, further comprising a fork protruding downward from the upper frame at the front portion of the base frame to support the flywheel.

9. The exercise equipment of claim 1, further comprising a seat mount attached to the rear portion of the base frame, and a seat adjustably attached to the seat mount.

10. The exercise equipment of claim 1 further comprising a resistance mechanism to increase a resistance of the flywheel, thereby requiring a greater force to rotate the flywheel.

11. The exercise equipment of claim 10, wherein the resistance mechanism comprises:

a. a resistance adjuster; and b. a resistance pad movably connected to the resistance adjuster, wherein the resistance adjuster modifies a force applied to the flywheel by the resistance pad.

* * * * *